US007278977B1

(12) United States Patent
Chen

(10) Patent No.: US 7,278,977 B1
(45) Date of Patent: Oct. 9, 2007

(54) BODY VIBRATING FACILITY

(75) Inventor: Ming Nan Chen, Taichung Hsien (TW)

(73) Assignee: Michael Lin, Chongsan Chu, Taipei (TW)

( * ) Notice: Subject to any disclaimer, the term of this patent is extended or adjusted under 35 U.S.C. 154(b) by 0 days.

(21) Appl. No.: 11/476,870

(22) Filed: Jun. 27, 2006

(51) Int. Cl.
*A61H 1/00* (2006.01)

(52) U.S. Cl. ..... 601/30; 601/49; 601/90; 601/93

(58) Field of Classification Search ..... 601/23, 601/24, 27, 29, 30–32, 46, 49, 50, 51, 53, 601/69, 84–87, 89, 90, 93, 97, 98, 100, 101, 601/104; 482/51–52
See application file for complete search history.

(56) References Cited

U.S. PATENT DOCUMENTS 2,271,382 A 1/1942 Worthington
2,935,064 A 5/1960 Moxley
6,083,180 A 7/2000 Shimizu
6,106,491 A * 8/2000 Gianutsos ..... 601/104
6,572,568 B2 * 6/2003 Huang ..... 601/29
2005/0033203 A1 * 2/2005 Son ..... 601/98
2006/0155221 A1 * 7/2006 Kim ..... 601/29

* cited by examiner

*Primary Examiner*—Quang D. Thanh
(74) *Attorney, Agent, or Firm*—Charles E. Baxley

(57) ABSTRACT

A body vibrating device includes two rods rotatably straddled between two plates, two followers attached to the rods and coupled together with a link, two foot supports attached to the followers, a reduction gearing device disposed on the base and having an eccentric member coupled to either of the followers for allowing the followers and the rods and the foot supports to be rotated and driven by the reduction gearing device, and a motor coupled to the reduction gearing device for driving the reduction gearing device to vibrate the followers and the rods and the foot supports. The foot supports may be stably supported and driven or vibrated by the motor.

8 Claims, 5 Drawing Sheets

BODY VIBRATING FACILITY

BACKGROUND OF THE INVENTION

1. Field of the Invention

The present invention relates to a body vibrating facility, and more particularly to a body vibrating facility including a stable structure for stably supporting a user thereon and for suitably vibrating and massaging the whole user' body and for facilitating the blood and/or lymph circulation of the user and for decomposing or for burning the fatty tissue and thus for suitably reducing the fat from the user.

2. Description of the Prior Art

Various kinds of typical body vibrating facilities have been developed and comprise a platform for supporting the user thereon, and a hollow vibrating facility coil and a pair of armatures provided for vibrating the platform in order to suitably vibrate and massage the user who is standing on the platform.

For example, U.S. Pat. No. 2,271,382 to Worthington discloses one of the typical platform foot and body vibrating facility also comprising one of two armatures attached or secured to a platform and a hollow vibrating facility coil for acting with the armatures and thus for generating magnetic fields or magnetic forces in order to vibrate or to swing the platform and thus to suitably vibrate and massage the user who is standing on the platform.

For moving or vibrating the platform, a great magnetic field and thus a great magnetic force are required to be generated by the hollow vibrating facility coil and the armatures. However, the magnetic field and the magnetic force generated by the hollow vibrating facility coil and the armatures are not good for the users and may have a good chance to hurt the users, particularly the nerve systems of the users.

U.S. Pat. No. 2,935,064 to Moxley discloses another typical foot massage apparatus comprising a motor including a spindle or armature shaft coupled to an eccentric member which is indirectly coupled to a platform with such as a cylindrical member or a frame work, such that the platform may only be operated or vibrated or moved with a relatively smaller moving or vibrating stroke by the eccentric member.

U.S. Pat. No. 6,083,180 to Shimizu discloses a further typical vibrating facility-type massaging device also comprising a motor coupled to two rotors each including an eccentric shaft extended upwardly therefrom for being moved or driven to move in circular and planar and horizontal plans such that the user may not be vibrated or moved up and down and such that the massaging effect is limited.

An additional motor may further be provided and coupled to a threaded shaft with a rotary gear for moving a vibrating plate up and down relative to a supporting casing. However, the moving speed of the vibrating plate by the threaded shaft and the motorized rotary gear is limited and may not be used to vibrate the vibrating plate and the users.

The present invention has arisen to mitigate and/or obviate the afore-described disadvantages of the conventional body vibrating facilities.

SUMMARY OF THE INVENTION

The primary objective of the present invention is to provide a body vibrating facility including a stable structure for stably supporting a user thereon and for suitably vibrating and massaging the whole user' body and for facilitating the blood and/or lymph circulation of the user and for decomposing or for burning the fatty tissue and thus for suitably reducing the fat from the user.

In accordance with one aspect of the invention, there is provided a body vibrating facility comprising a base, two plates disposed on the base and spaced away from each other, two rods rotatably attached to the plates and straddled between the plates, two followers attached to the rods and rotated in concert with the rods respectively, a link pivotally coupled between the followers with pivot pins for allowing the followers and the rods to be pivotally coupled together, two foot supports attached to the followers and rotated in concert with the followers and the rods respectively, a reduction gearing device disposed on the base and including an eccentric member coupled to either of the followers for allowing the followers and the rods and the foot supports to be rotated and driven by the reduction gearing device, and a motor coupled to the reduction gearing device for driving the reduction gearing device to rotate and to vibrate the followers and the rods and the foot supports. The foot supports may be stably supported and driven or vibrated by the motor.

The motor includes a spindle, the reduction gearing device includes a pulley attached thereto and coupled to the spindle of the motor with a belt for allowing the reduction gearing device to be rotated and driven by the motor.

The eccentric member of the reduction gearing device is coupled to either of the pivot pins of the followers with a lever for allowing the followers and the rods and the foot supports to be rotated and driven or vibrated by the motor with the reduction gearing device.

The followers each include at least two panels attached to the rods and secured to the foot supports respectively for allowing the foot supports to be stably secured to and supported by the followers and the rods respectively.

The rods are rotatably attached to the plates with bearings. The base include a post extended upwardly therefrom for supporting a displayer or a control device thereon. The base include at least one handle device disposed thereon for supporting an upper portion of a user.

The base include a housing engaged thereon for covering and shielding the plates, the followers, the rods, the motor and the reduction gearing device. It is preferable that the foot supports are coupled to the housing with a bellows type coupling member for preventing a gap or slot from being formed between the foot supports and the housing, and thus for preventing the user from being clamped or hurt by or between the foot supports and the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
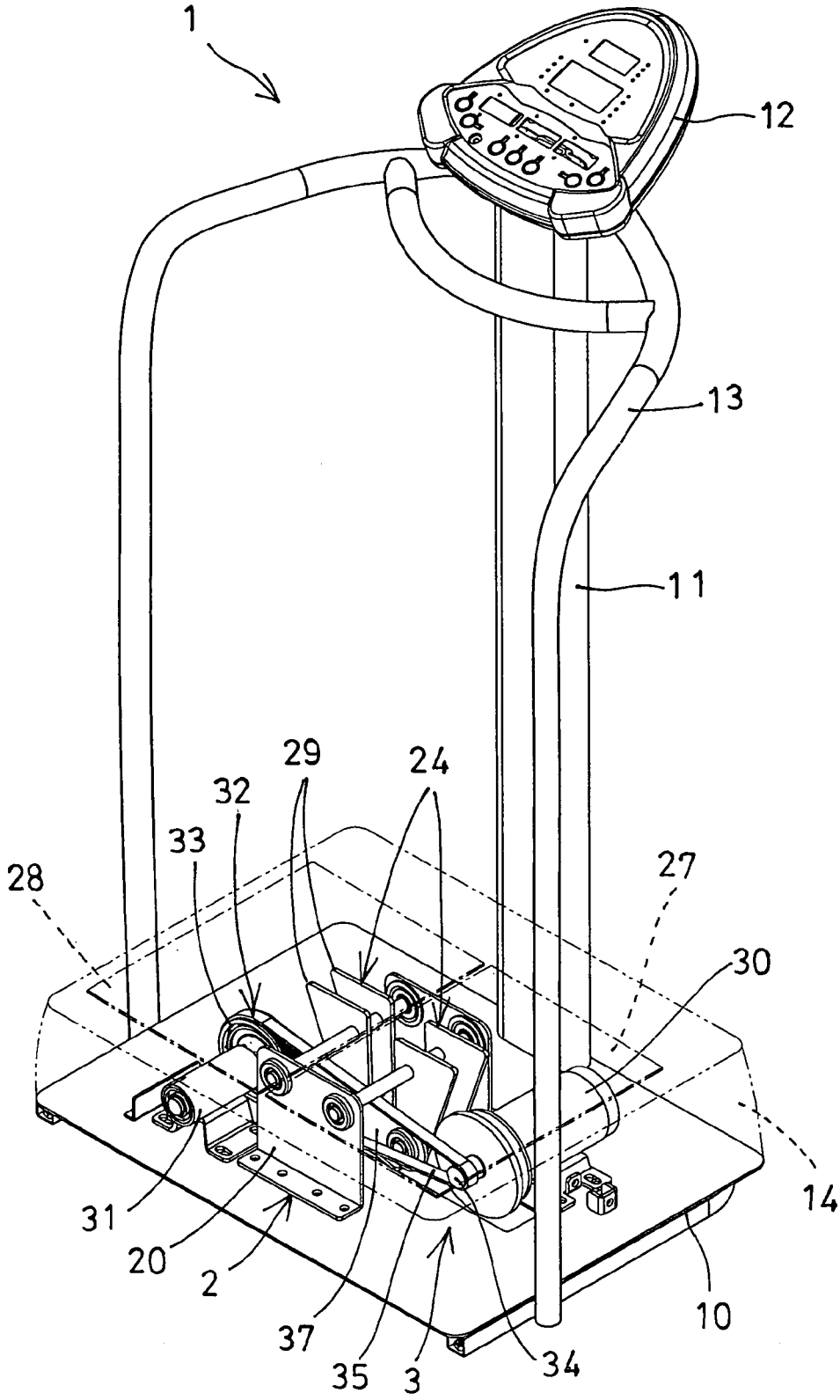
FIG. 1 is a partial perspective view of a body vibrating facility in accordance with the present invention as seen from the rear portion of the body vibrating facility.

Referring to the drawings, and initially to FIGS. 1-4, a body vibrating facility 1 in accordance with the present invention comprises a base 10 for supporting a support device 2 and a vibrating device 3 thereon, and including a post 11 extended upwardly therefrom, such as extended upwardly from the front portion thereof for supporting a displayer or control device 12 thereon, and including one or more handle devices 13 disposed thereon and/or attached or coupled to the post 11 for supporting the upper portions of the users, and including a cover or housing 14 engaged or attached onto the base 10 for covering or shielding or protecting the support device 2 and the vibrating device 3 and for preventing the support device 2 and the vibrating device 3 from being exposed.

The support device 2 includes one or more, such as two plates 20 disposed on the base 10 and spaced away from each other and preferably parallel to each other, two rods 21, 22 rotatably attached or disposed to the plates 20 with bearings 23 and disposed or straddled between the plates 20, two followers 24 attached or secured to the rods 21, 22 and rotated in concert with the rods 21, 22 respectively, and a link 25 pivotally coupled between the lower portions of the followers 24 with pivot pins 26 (FIG. 3) for allowing the followers 24 and thus the rods 21, 22 to be pivotally coupled together. Two foot pedals or supports 27, 28 are attached or secured to the followers 24 respectively and also rotated in concert with the followers 24 and the rods 21, 22 respectively.

Figure 2:
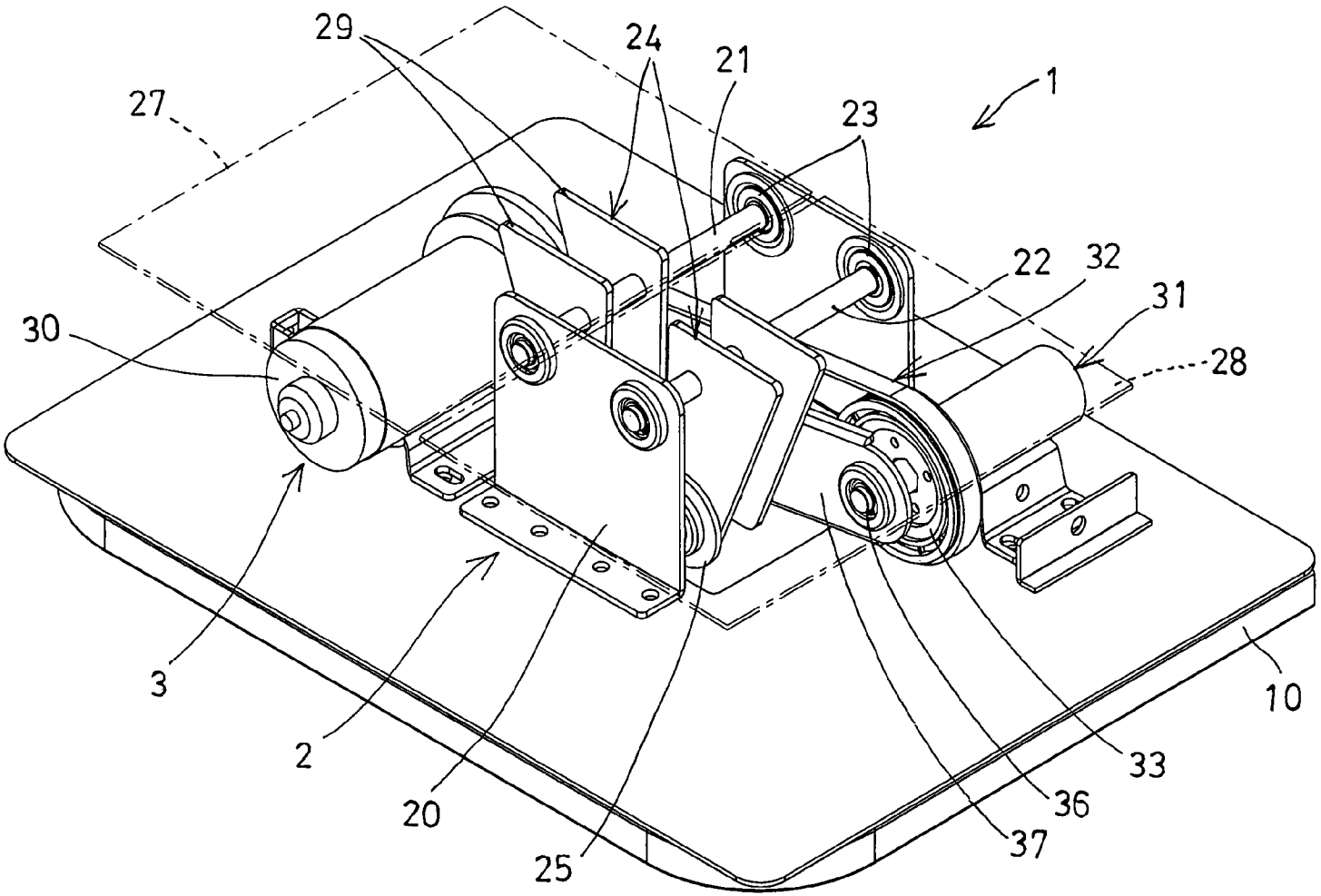
FIG. 2 is an enlarged partial perspective view illustrating a vibrating device of the body vibrating facility as seen from the front portion of the body vibrating facility.
Figure 3:
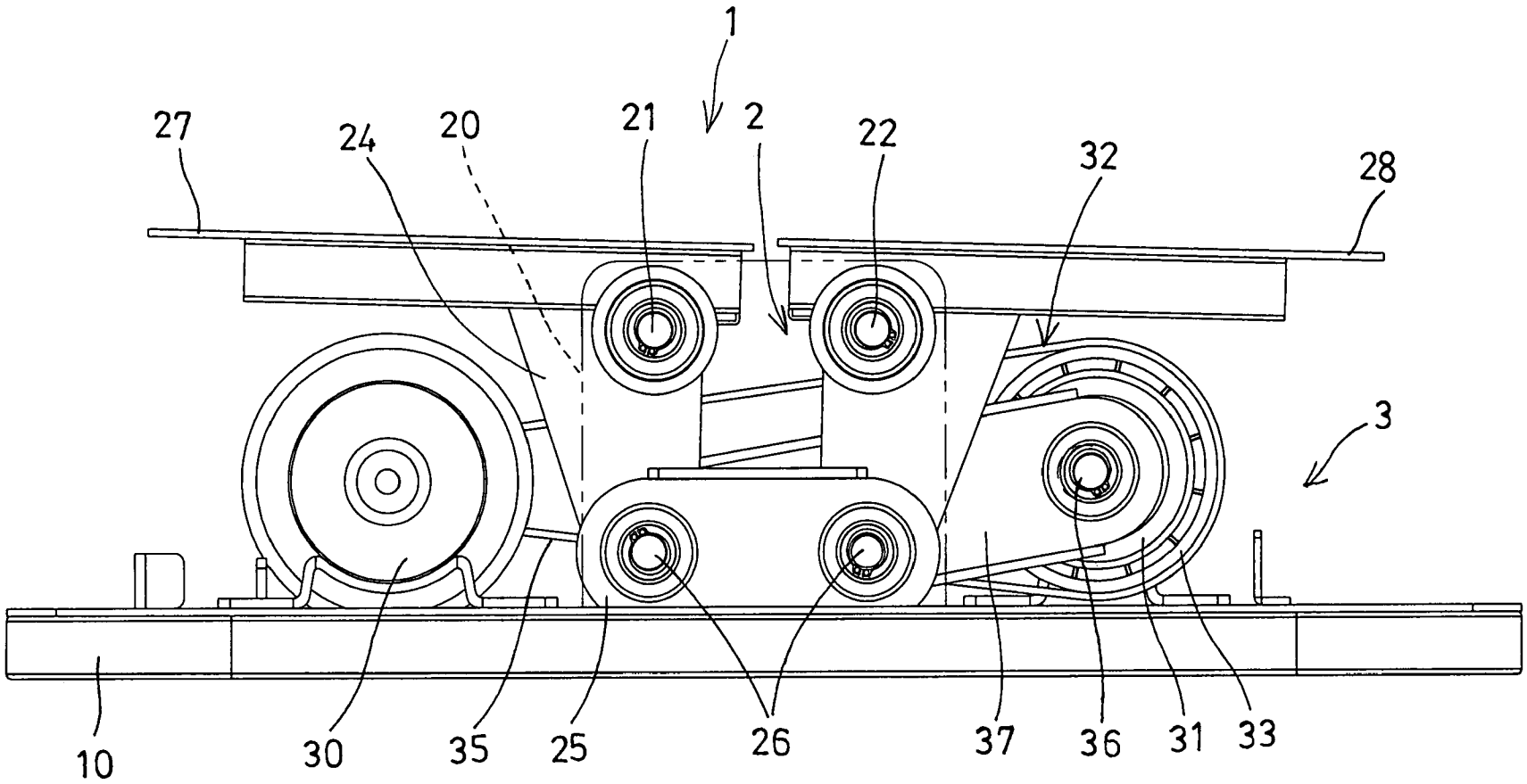
FIG. 3 is a front plan schematic view illustrating the vibrating device of the body vibrating facility.
Figure 4:
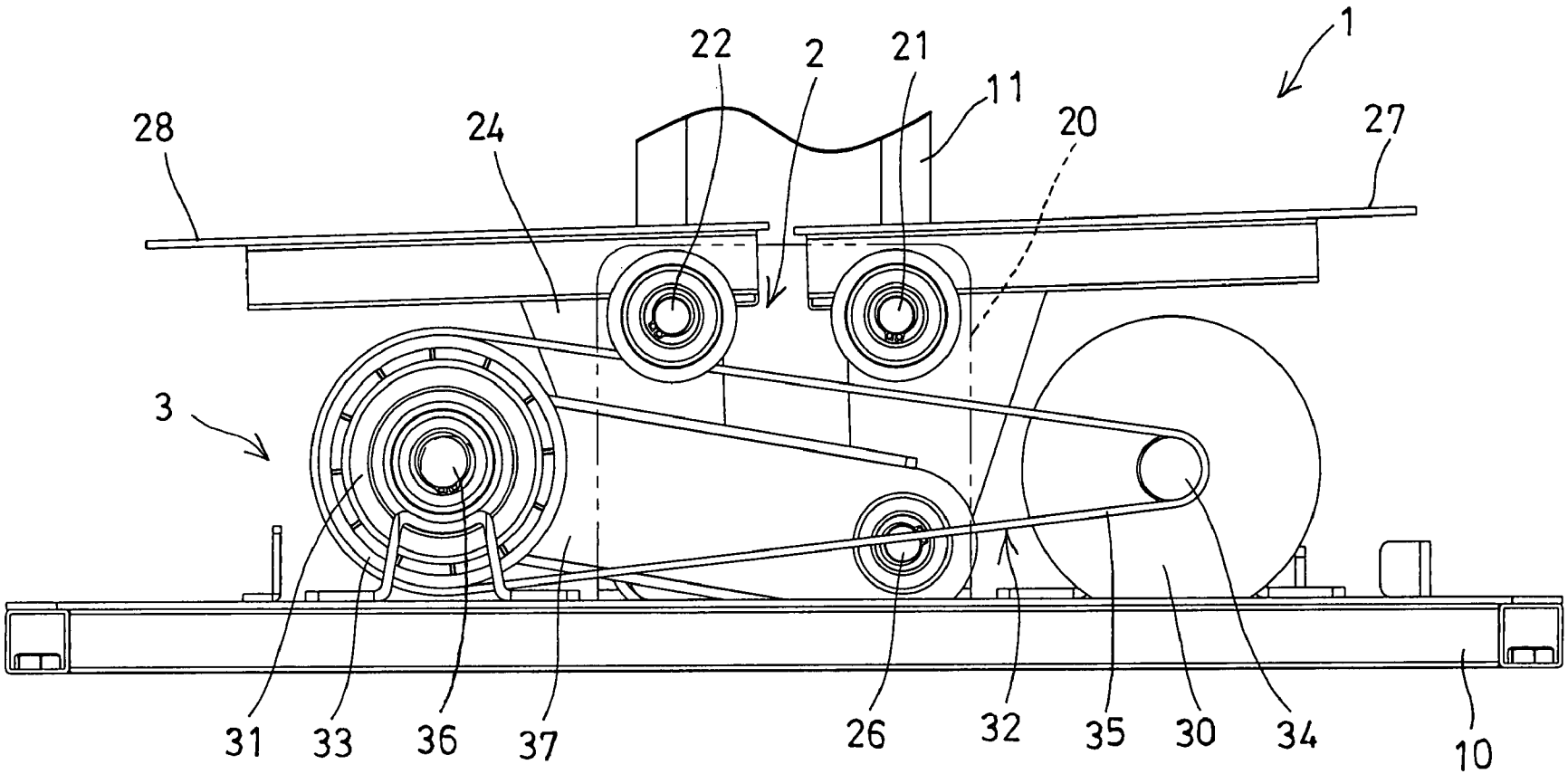
FIG. 4 is a rear plan schematic view illustrating the vibrating device of the body vibrating facility.

As best shown in FIGS. 1 and 2, it is preferable that the followers 24 each include two or more panels 29 attached or secured to the rods 21, 22 and preferably parallel to each other and solidly secured to the foot supports 27, 28 respectively with such as fasteners or latches (not shown) or with adhesive materials, or by welding processes, or the like, for allowing the foot supports 27, 28 to be stably and solidly secured to and supported by the followers 24 and the rods 21, 22 respectively and for preventing the foot supports 27, 28 from being tilted or inclined relative to the followers 24 and the rods 21, 22 respectively, and thus for allowing the users to be stably supported on the foot supports 27, 28.

The vibrating device 3 includes a motor 30 and a reduction gearing device 31 disposed on the base 10 and coupled together with a coupling means or device 32 which includes a pulley 33 attached or secured to the reduction gearing device 31 and coupled to the spindle 34 of the motor 30 with a belt 35 for allowing the reduction gearing device 31 to be rotated or driven by the motor 30. However, the coupling device 32 may also be selected from the gearing coupling device 32, the sprocket-and-chain coupling device 32, the motorized threaded coupling device 32, or the like.

Figure 5:
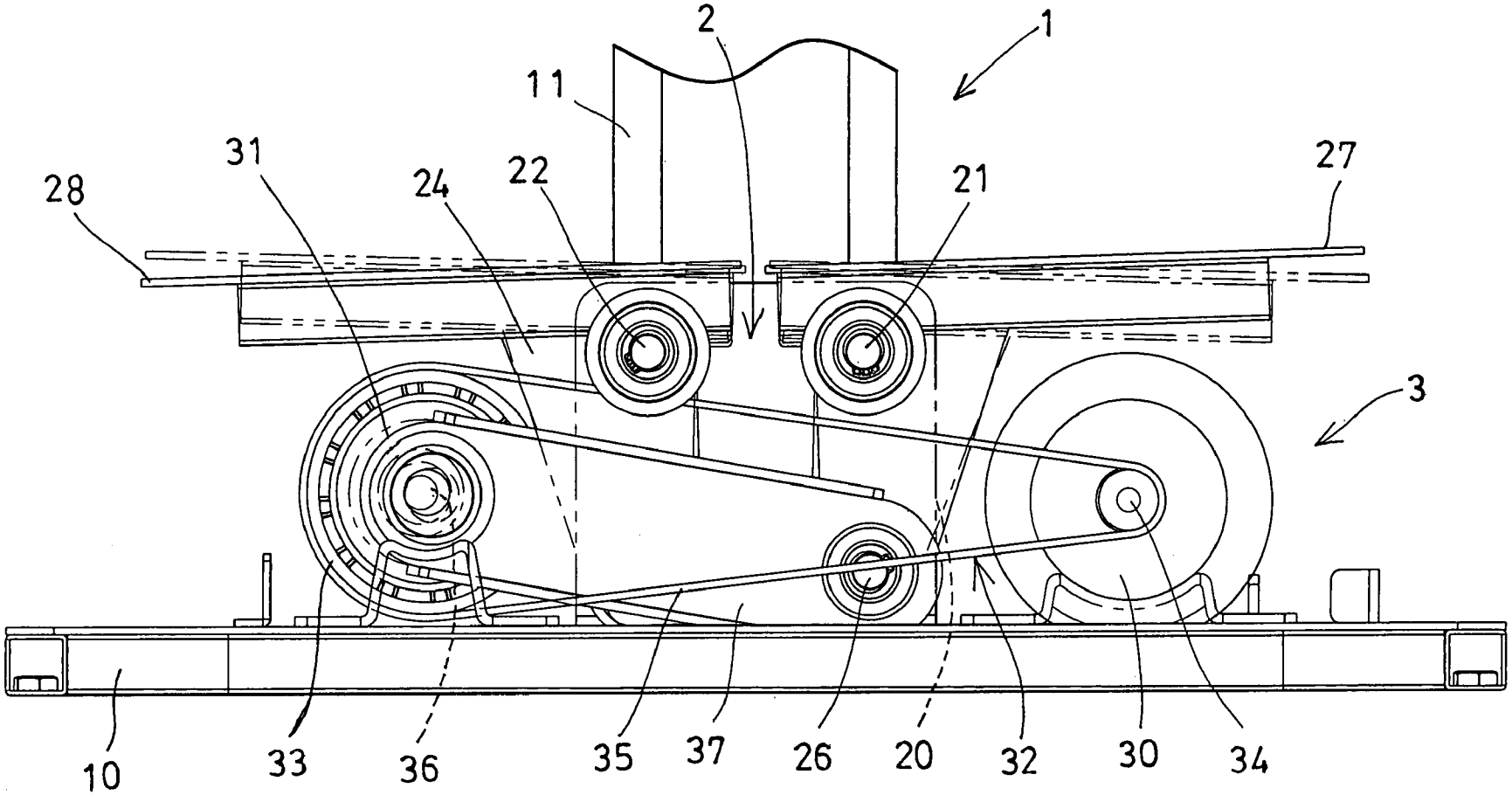
FIG. 5 is a rear plan schematic views similar to FIG. 4, illustrating the operation of the body vibrating facility.

The reduction gearing device 31 includes a crank or eccentric member 36 attached thereto or extended therefrom (FIGS. 2, 4, 5), such as extended from either the spindle 34 or the pulley 33 and coupled to either of the pivot pins 26 of the followers 24 (FIGS. 4, 5) with a lever 37 for allowing the followers 24 and thus the rods 21, 22 and the foot supports 27, 28 to be rotated or driven by the motor 30 via or with the reduction gearing device 31 and the eccentric member 36 and the lever 37, such that the foot supports 27, 28 and thus the user supported on the foot supports 27, 28 may be swung or vibrated by the motor 30. It is preferable that the foot supports 27, 28 are coupled to the housing 14 with a bellows type coupling member (not shown) for preventing a gap or slot from being formed between the foot supports 27, 28 and the housing 14 and for preventing the user from being clamped or hurt by or between the foot supports 27, 28 and the housing 14.

It is to be noted that the foot supports 27, 28 may be solidly and pivotally coupled the motor 30 via or with the followers 24, the rods 21, 22, the link 25, the lever 37, the eccentric member 36, and the reduction gearing device 31, and may thus be effectively swung or vibrated by the motor 30, in order to effectively swing or vibrate the whole user' body and to facilitate the blood and/or lymph circulation of the user and to decompose or to burn the fatty tissue of the user and thus for suitably reducing the fat from the user. The lever 37, the eccentric member 36, and the reduction gearing device 31 may thus be formed or acted as a coupling means or mechanism or device for pivotally coupling the motor 30 to the foot supports 27, 28.

Accordingly, the body vibrating facility in accordance with the present invention includes a stable structure for stably supporting a user thereon and for suitably vibrating and massaging the whole user' body and for facilitating the blood and/or lymph circulation of the user and for decomposing or for burning the fatty tissue and thus for suitably reducing the fat from the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A body vibrating facility comprising:

a base, two plates disposed on said base and spaced away from each other, two rods rotatably attached to said plates and straddled between said plates, two followers attached to said rods and rotated in concert with said rods respectively, a link pivotally coupled between said followers with pivot pins for allowing said followers and said rods to be pivotally coupled together, two foot supports attached to said followers and rotated in concert with said followers and said rods respectively, a reduction gearing device disposed on said base and including an eccentric member coupled to either of said followers for allowing said followers and said rods and said foot supports to be rotated and driven by said reduction gearing device, and a motor coupled to said reduction gearing device for driving said reduction gearing device to rotate and to vibrate said followers and said rods and said foot supports.

2. The body vibrating facility as claimed in claim 1, wherein said motor includes a spindle, said reduction gearing device includes a pulley attached thereto and coupled to said spindle of said motor with a belt for allowing said reduction gearing device to be rotated and driven by said motor.

3. The body vibrating facility as claimed in claim 1, wherein said eccentric member of said reduction gearing device is coupled to either of said pivot pins of said followers with a lever for allowing said followers and said rods and said foot supports to be rotated and driven by said reduction gearing device.

4. The body vibrating facility as claimed in claim 1, wherein said followers each include at least two panels attached to said rods and secured to said foot supports respectively for allowing said foot supports to be stably secured to and supported by said followers and said rods respectively.

5. The body vibrating facility as claimed in claim 1, wherein said rods are rotatably attached to said plates with bearings.

6. The body vibrating facility as claimed in claim 1, wherein said base include a post extended upwardly therefrom for supporting a control device thereon.

7. The body vibrating facility as claimed in claim 1, wherein said base include at least one handle device disposed thereon for supporting an upper portion of a user.

8. The body vibrating facility as claimed in claim 1, wherein said base include a housing engaged thereon for covering and shielding said plates, said followers, said rods, said motor and said reduction gearing device.

* * * * *